US007360738B2

(12) United States Patent
Perini

(10) Patent No.: US 7,360,738 B2
(45) Date of Patent: Apr. 22, 2008

(54) METHOD FOR PRODUCING VARIOUSLY SIZED PAPER LOGS

(76) Inventor: Fabio Perini, Via S. Francesco, 1, I-55049 Viareggio (IT)

( * ) Notice: Subject to any disclaimer, the term of this patent is extended or adjusted under 35 U.S.C. 154(b) by 0 days.

(21) Appl. No.: 11/532,695

(22) Filed: Sep. 18, 2006

(65) Prior Publication Data

US 2007/0023562 A1 Feb. 1, 2007

Related U.S. Application Data

(62) Division of application No. 10/496,168, filed on May 18, 2004, now Pat. No. 7,175,126.

(30) Foreign Application Priority Data

Jul. 8, 2002 (IT) ..... FI2002A0119

(51) Int. Cl.
*B65H 19/28* (2006.01)
*B65H 75/28* (2006.01)

(52) U.S. Cl. ..... 242/532.3; 242/542.1; 242/533.1

(58) Field of Classification Search ..... 242/526.1, 242/532.3, 533.1, 527.2, 542, 542.1, 542.2
See application file for complete search history.

(56) References Cited

U.S. PATENT DOCUMENTS

| | | | | |
|---|---|---|---|---|
| 4,635,867 A | | 1/1987 | Kytoenen | |
| 4,711,405 A | | 12/1987 | Niskanen | |
| 5,009,736 A | | 4/1991 | Lehto | |
| 5,653,401 A | | 8/1997 | Biagiotti | |
| 5,979,818 A | | 11/1999 | Perini et al. | |
| 6,050,519 A | * | 4/2000 | Biagiotti | 242/526.1 |
| 6,098,916 A | * | 8/2000 | Matteucci et al. | 242/527.3 |
| 6,676,063 B2 | * | 1/2004 | Gambini | 242/521 |
| 6,752,344 B1 | * | 6/2004 | Biagiotti | 242/521 |
| 6,945,491 B2 | * | 9/2005 | Gambini | 242/521 |
| 2002/0079402 A1 | * | 6/2002 | Gambini | 242/532.3 |
| 2002/0179768 A1 | * | 12/2002 | Gambini | 242/521 |

FOREIGN PATENT DOCUMENTS

| | | |
|---|---|---|
| EP | 0 694 020 B1 | 7/1977 |
| EP | 1 006 066 A2 | 6/2000 |

* cited by examiner

*Primary Examiner*—Peter M. Cuomo
*Assistant Examiner*—Sang Kim
(74) *Attorney, Agent, or Firm*—McGlew and Tuttle P.C.

(57) ABSTRACT

A method for producing logs of paper comprises:
feeding a continuous paper web along a fixed path;
transversely perforating the paper web such that the paper can be subdivided into various lengths and detached by tearing;
feeding tubes such that a preset number of sheets are wound onto said tube to form a log, the tubes being guided in a tube-guiding channel extending between a tube-feeding station and a log-forming station, the channel being delimited in part by a fixed guide and in part by a roller for feeding the paper; and
applying glue within the channel such that the last sheet is glued to the log being formed and the paper web is glued to the next tube.

8 Claims, 21 Drawing Sheets

METHOD FOR PRODUCING VARIOUSLY SIZED PAPER LOGS

CROSS REFERENCE TO RELATED APPLICATIONS

This application is a divisional application under 37 CFR 1.53(b) of application Ser. No. 10/496,168, now U.S. Pat. No. 7,175,126 B2 filed May 18, 2004.

FIELD OF THE INVENTION

The present invention refers to a method for producing paper rolls (so-called "logs" in the technical jargon) of various size.

BACKGROUND OF THE INVENTION

The production of logs is known to require the supply of a continuous paper web along a predetermined path. At a point of said path, a discontinuous transverse cut is operated on the web in order to subdivide it into portions or sheets of preset length to be separated by a tear.

The formation of logs implies the use of tubular cardboard spools (commonly referred to as "cores") on the surface of which a preset amount of glues is distributed to allow the glueing of the first sheet of the log to be formed.

The formation makes also use of winder rollers which drive the core, on which the paper winds up, into rotation.

The process of formation of a log terminates after a preset amount of paper has been wound over the core.

At this point, the formation of the next log is started.

Upon completion of the said formation it is necessary to glue the last sheet of each log on the underlying sheet, to avoid the spontaneous unwinding of the same log. This type of glueing is defined "edge closing".

To this end, downstream of the unit for the formation of the log a suitable glueing device is provided to which all the formed logs are fed. Each log is to be cut transversally afterwards, to obtain therefrom a plurality of rolls of paper of commercial format.

A rewinding machine for the production of logs is described in details in the patent EP 694020.

The above described technique of forming a log requires therefore an auxiliary device for glueing. This weighs heavily on the running costs and demands more space for the production system.

There are also other considerations to be made on the above technique. One important aspect to be considered relates to the procedure for spreading the glue onto the core, as necessary to fix the first sheet of the log to be formed. On the machines presently known, this procedure is carried out outside the winding region: the glue is distributed onto the cores to be used afterwards for the formation of the log, prior to the same cores entering the region in which they come in contact with the paper web. This operating mode, in the case of a prolonged stop of the machine, may lead to the drying of the glue present onto the cores. It should be understood that such a situation, if not suitably rectified, leads to a faulty process. In fact, on the machines of this type, the operator is bound, under such conditions, to remove manually the core previously glued.

A further consideration, again concerning the glue spread onto the core, refers to the stage in which the size of the log becomes increasingly larger between the winding rollers. The weight of the glue applied onto the core, in the case the latter is distributed longitudinally on a rather thick line, is cause for an "unbalance" of the same core which, when considering the speed involved, may induce strong vibrations on the log in the course of formation. This phenomenon, which can be self-intensifying, may lead to the formation of a log in which the core results out of axis.

SUMMARY OF THE INVENTION

The main object of the present invention is to overcome the previously mentioned drawbacks.

The present invention makes it possible to avoid using gluing devices of "edge closing" type with significant advantages, as far as cost and space are concerned. Moreover, it allows overcoming the said drying and "unbalance" problems above described.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 14B is a front view of the blade of FIG. 14A;

DESCRIPTION OF THE PREFERRED EMBODIMENTS

Figure 1:
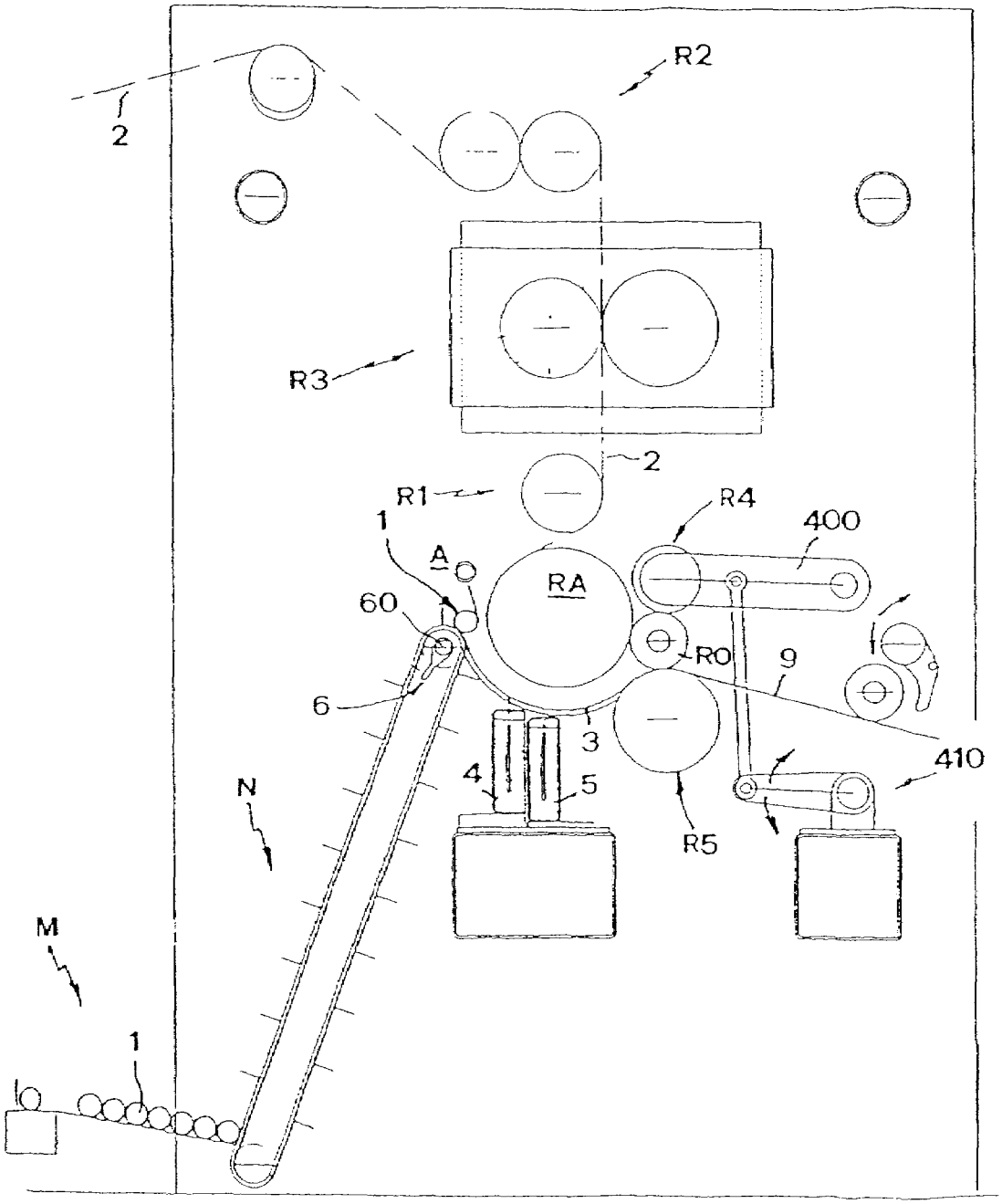
FIG. 1 is a schematic illustration of a machine which makes it possible to actuate a method according to the invention.
Figure 2:
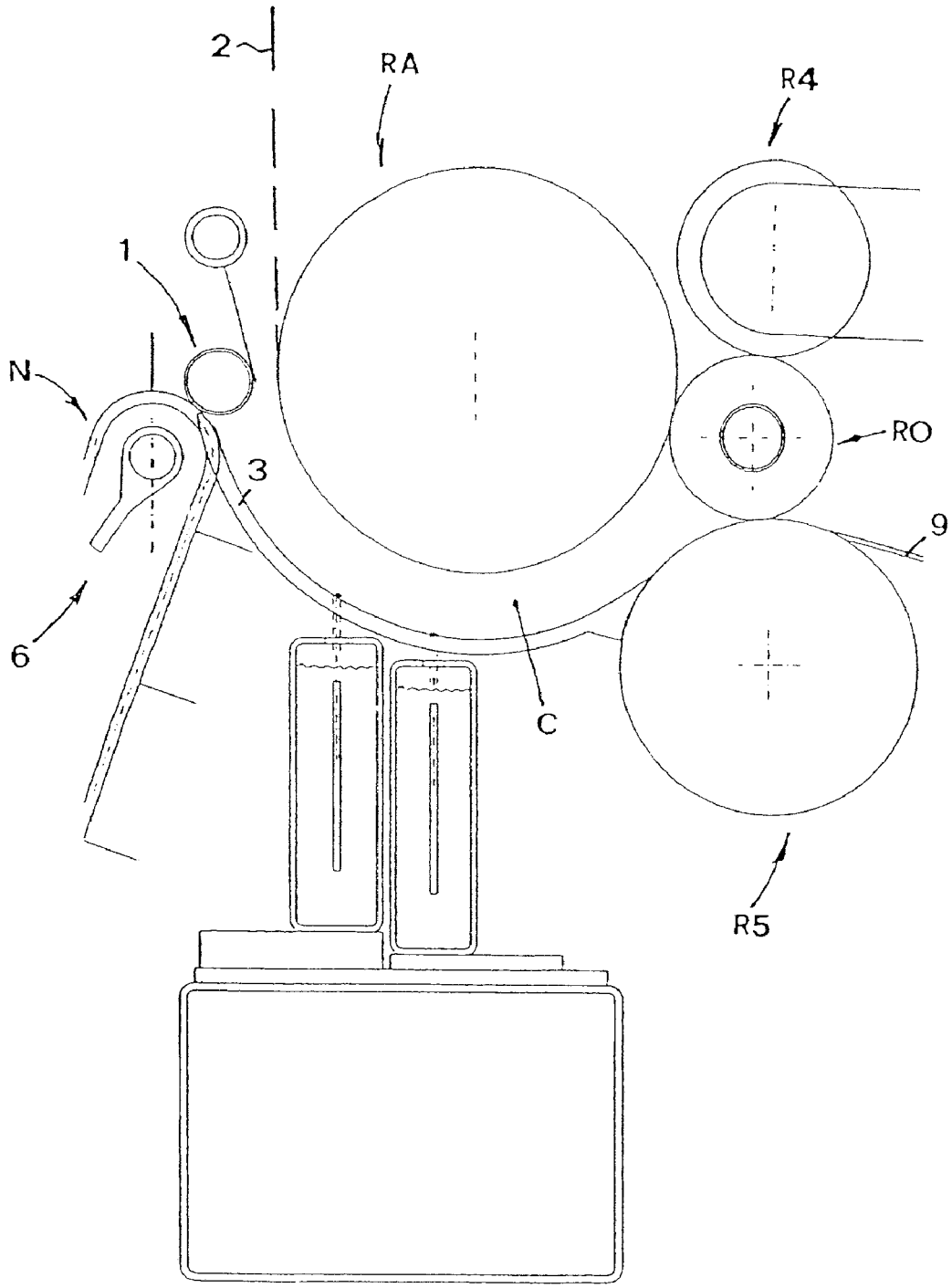
FIG. 2 shows an enlarged detail of the drawing of FIG. 1.

Referring to the drawings in particular, FIG. 1, a method according to the present invention can be actuated by means of a machine comprising:

a station (A) for feeding the cores (1);

a store (M) for housing the cores (1);

means for supplying the station (A) with cores (1) removed from the store by a chain delivery system (N) extending between the station (M) and station (A);

means for feeding and transversally pre-cutting or perforating the paper (2) by means of a plurality of feeding, driving, and cutting rollers (R1, R2, R3, RA) disposed along a predetermined path which includes also the station (A) for the supply of cores (1); and means for rolling up the paper (2) onto the core (1) by means of two winder rollers (RA, R4, R5), the two rollers (R4 and R5) of which overlap at the outlet of a channel (C) being delimited by a fixed curvilinear guide (3) and the surface of roller (RA).

The roller (RA) has the dual function of feeding the paper (2) and winding it onto the core (1), as will be best described later.

The above said channel (C) delimits the last stretch of the path covered by the paper (2) and also the path followed by each core (1) which leaves the core-feeding station (A) and moves towards the exit of channel (C).

Advantageously, according to the invention, first and second means (4, 5) are provided for delivering a preset amount of glue onto the surface of each core (1) introduced into the channel (C). Said glue-delivering means (4, 5) act in correspondence of the channel (C) according to a precise sequential order. This provides for the first delivery of the glue to the last sheet of log (RO) in the course of formation and, then, for the delivery of glue intended to attach the first sheet of a new log on a corresponding core (1) suitably introduced into the channel (C).

As will be best described later on, the delivery of glue by the first and second means (4, 5) is alternated by the transit of a perforation line (p) which separates the last sheet of log (RO) in the course of formation from the first sheet of the next log to be formed.

More particularly, and reference being made to the FIGS. 3-10, the normal operating condition takes place as described below.

Figure 4:
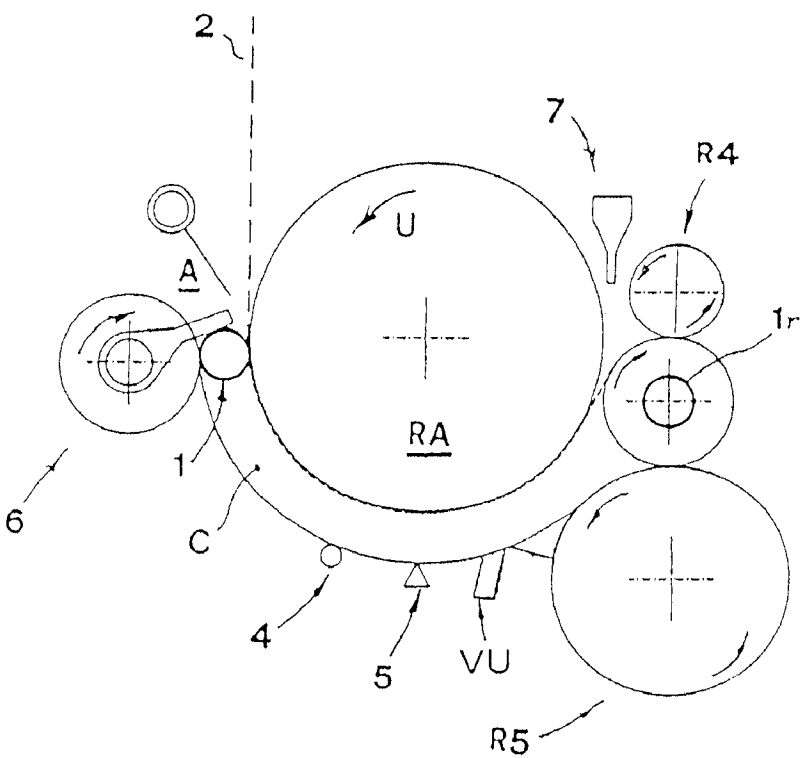
FIGS. 3-10 shows schematically a sequence of steps relating to the operation of the machine of FIG. 1.
Figure 3:
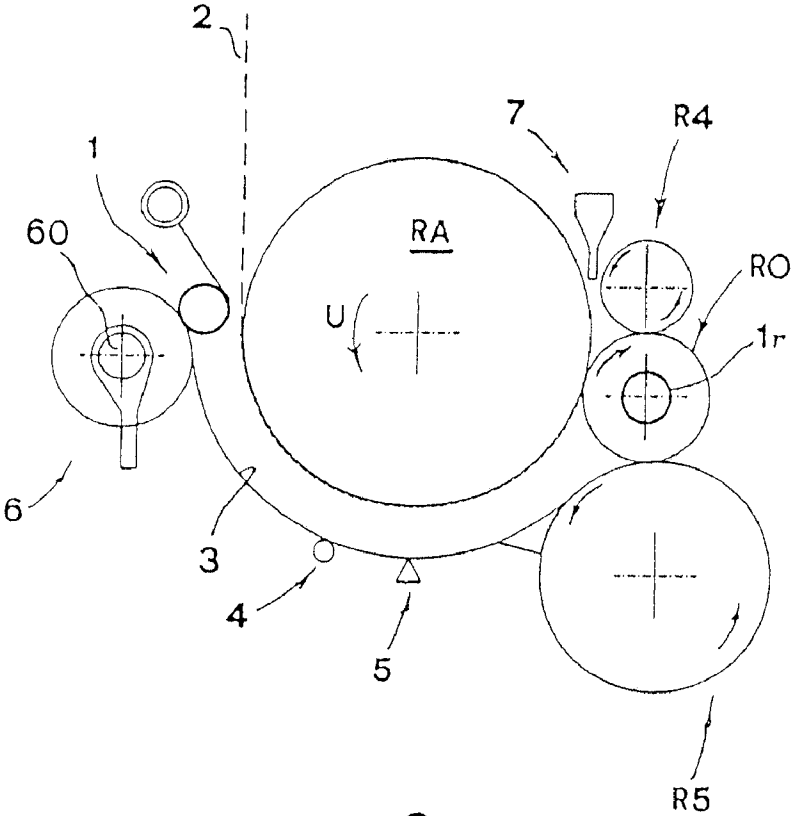

After winding a preset number of sheets onto the core (1) of log (RO) under formation, the lever (6), which introduces the core (1) standing by at the station (A) (FIG. 3), operates the introduction of one core (1) into the channel (C) by rotating about its axis (60) and pushing the same core from the back (FIG. 4). Upon this stage, the formation of the log (RO) continues on the opposite side of channel (C), so that the paper continues to wind up onto the relevant core (1*r*) by means of the winder rollers (RA, R4, R5).

The core (1), freshly introduced into the channel (C), begins to advance and to roll at the same time by virtue of the contact of its surface with the surface of the roller (RA) which rotates about its own axis, as indicated by the arrow (U).

During the step in which the core (1) is introduced into the channel (C), the angular speed of roller (R5) is decreased with respect to that of roller (RA) and roller (R4). This situation causes the log under formation (RO) to move away from the surface of roller (RA). The angular speed of roller (R4) is then set equal to that of roller (R5). The speed difference between roller (R5) and roller (RA) determines a reduction of tension and, therefore, a loosening of the paper web (2) upstream of rollers (R4, R5) and implies also a detachment of the paper from the surface of roller (RA) (FIG. 4). This detachment occurs along the channel (C) over a length extending between the core (1) and winder rollers (R4, R5). The detachment of the paper from roller (RA) can be made easier by a blow of compressed air through a nozzle (7) acting between the surface of roller (RA) and the station of the winder rollers (R4, R5). As an alternative to the blow operated through the nozzle (7), a suction may be operated on the side of guide (3). In the drawings, (VU) denotes a suction unit.

Figure 6:
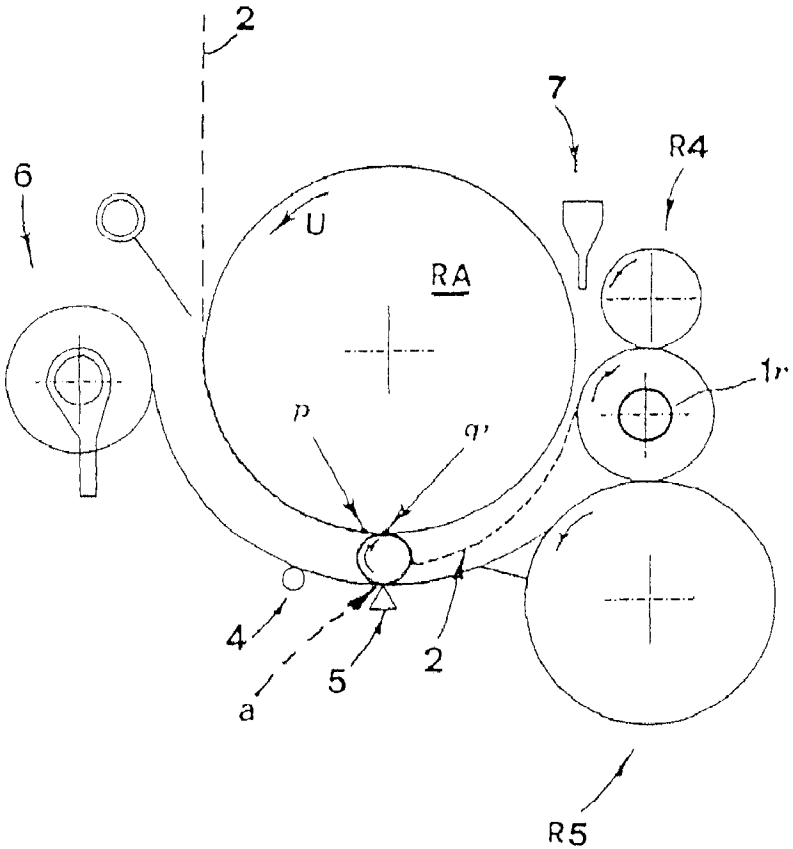
Figure 5:
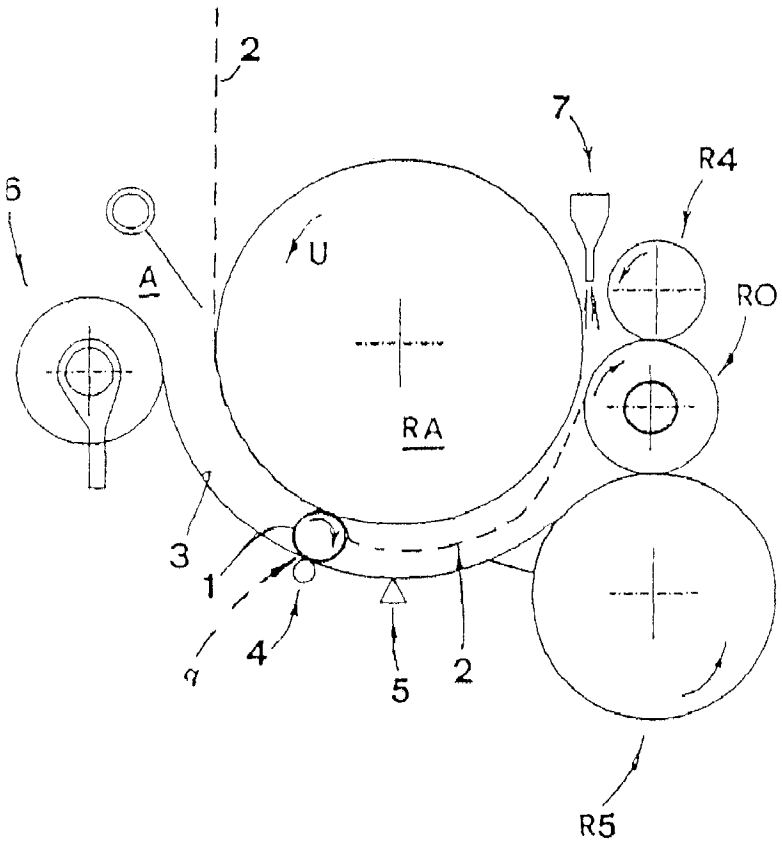
Figure 8:
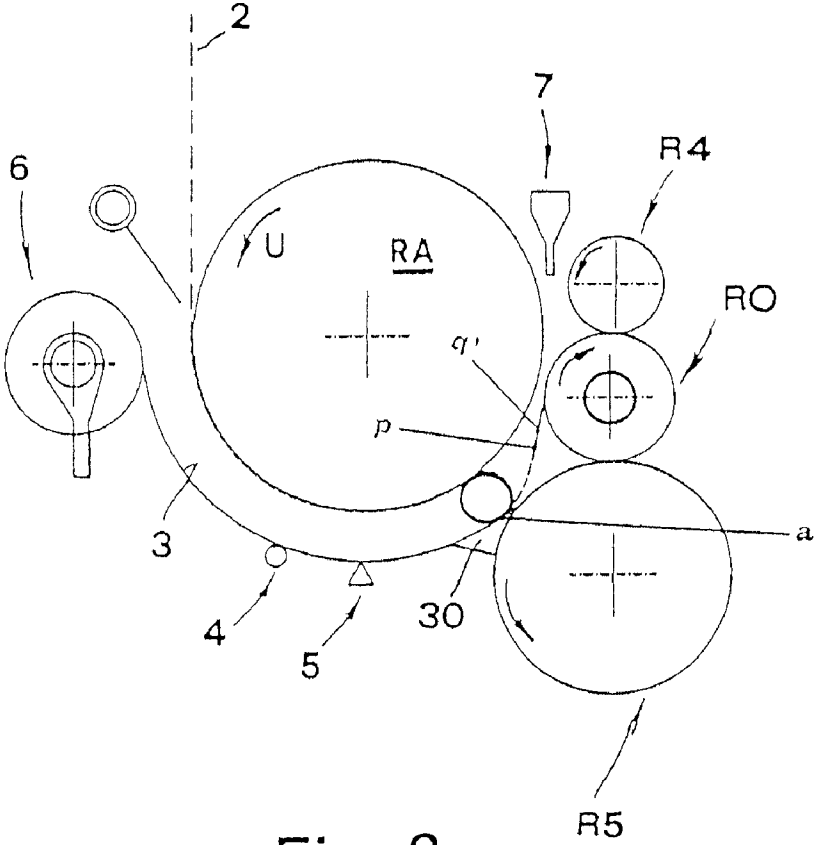

When the core (1), by virtue of its advancing along the channel (C), arrives in correspondence of the first glue-delivering means (4), these are activated and, accordingly, a preset amount of glue is applied on the surface of core (1) (FIG. 5). When this core (1) arrives in correspondence of the second glue-delivering means (5), these are activated as well (FIG. 6). The distance between the first (4) and second (5) means is properly selected so that, in correspondence of the second means (5), the core (1) will result rotated through an angle relative to the position taken up in correspondence of the first means (4) (FIG. 6). In any case, the perforation line (p) on the paper (2) results included between the regions (q, a) subjected to the actions of the first and second glue-delivering means (4, 5). In this way, the delivery of the glue by the first means (4) will interest the last sheet of log (RO) under formation, while the delivery of glue by the second means (5) will cause the glueing on the core (1) of the first sheet of the new log under formation.

As shown in greater detail in FIG. 6, when the core (1), owing to its combined advancement and rolling up along the channel (C), arrives over the second glue-delivering means (5), the region (q) of paper web (2) comes in contact with the region of core (1) previously interested by the action of the first glue-delivering means (4). Depending on the position of said glue-delivering means (4, 5), the region (q) results offset by a well defined angle relative to the region (a) of core (1) onto which the second means (5) are made to act.

FIG. 6 shows the case in which the position of said means (4, 5) is such that the region (q) and (a), acted upon by means (4, 5), result diametrically opposite on the core (1), so that the said angle is of approximately 180°.

The core (1), by moving and rolling up forwards along the channel (C), transfers most of its glue, applied by the means (4), to the region (q') of the paper web. The region (q) belongs to the last sheet of log (RO) under formation inasmuch as it results downstream of the perforation line (p) which defines the end of the same log (RO). In practice, an edge (q') of the last sheet of log (RO) under formation results thus glued, that is, provided with glue, at some distance from line (p): the core (1) makes up the means by which the glue is applied on the last sheet of the log (RO) since, at least in part (though in sufficient amount), the glue is transferred by contact from the core (region q) to the paper (edge or region q').

By keeping on along its path, the core (1) passes also the second glue-delivering means (5) and, by virtue of its rolling up along the channel (C), also the region (a) of the same core (1) arrives in contact with the paper web (2), at a region of the sheet which follows the line (p). This sheet is the first one of the subsequent log to be formed. The glue in the region (a) is such as to cause the paper web (2) to adhere onto the core (1) which web, in the meantime and as previously mentioned, has become somewhat loose in the region between the core (1) and the end of the channel (C), by virtue of the reduction of speed of the winder rollers (R4, R5) with respect to roller (RA) (FIG. 7).

Figure 7:
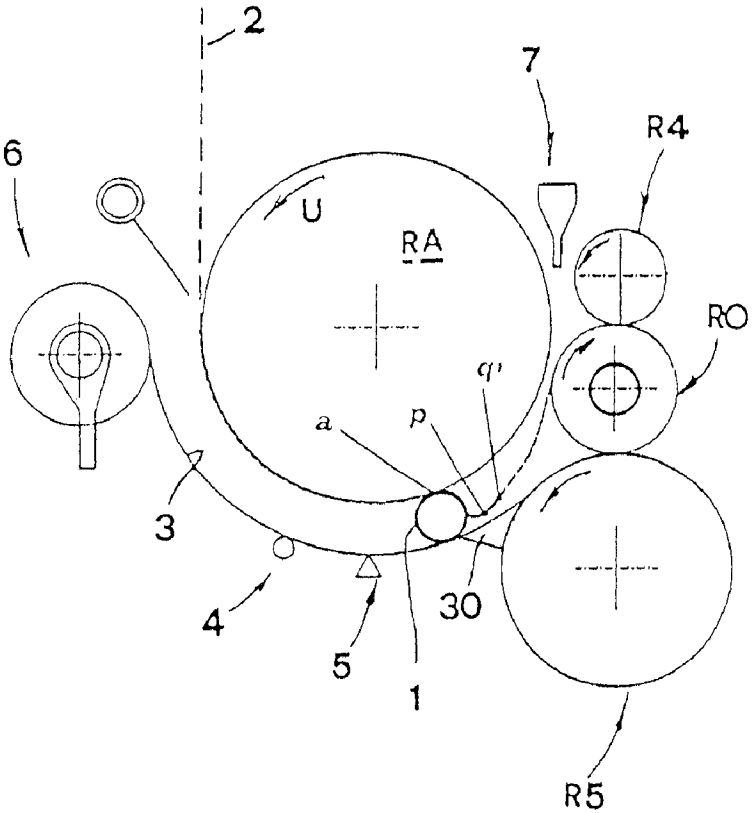
Figure 9:
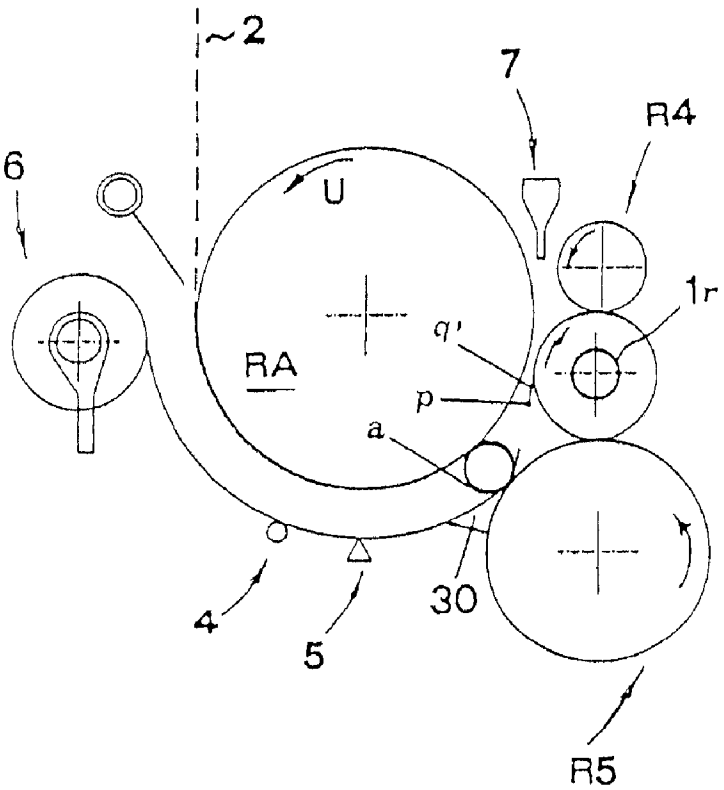

The loosening effect of the paper web (2), in combination with the adhesion of the same web onto the core (1) caused by the glue present in the region (a), is such that, during the rolling up of core (1), there occurs a progressive winding of the paper web (2) onto the core (1) (FIG. 7). Thereafter, in correspondence of the terminal portion (30) of the guide (3), the first sheet of the next log to be formed results fitted (again by the effect of rolling and advancement of core (1)) between the surface of the said portion (30) and the surface of core (1) (see FIG. 8). Owing to this, and to the fact that the winder rollers (R4, R5) keep on rotating, the part of the paper web (2) which results compressed between the surface (30) of guide (3) and the log (RO) under formation is subjected to such a tensioning as to cause a tear in correspondence of the line (p), as shown in FIG. 9.

Figure 10:
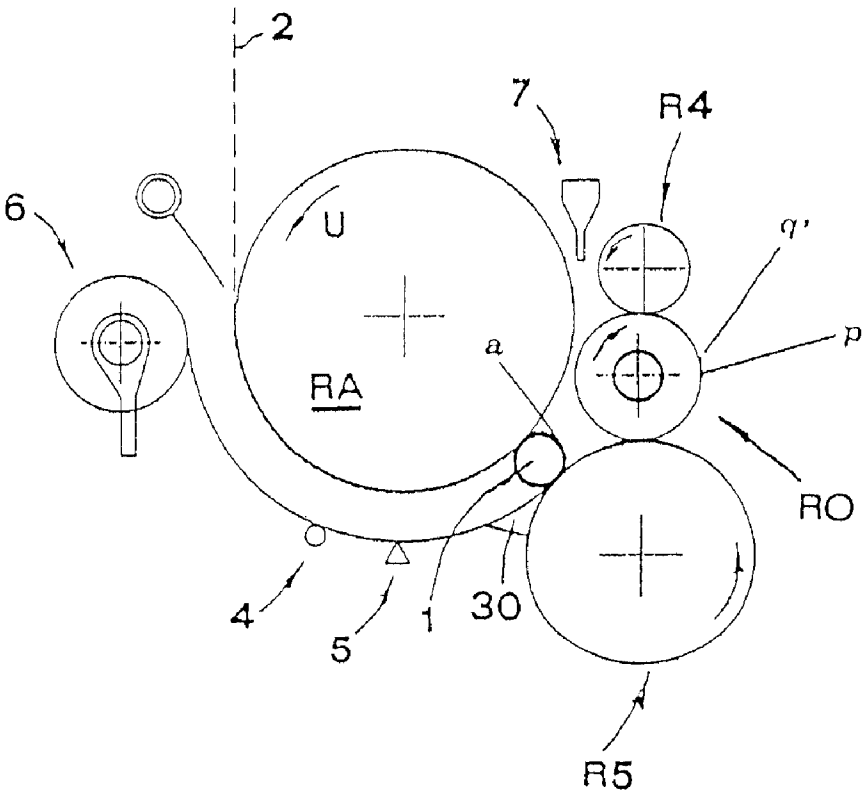

By keeping on to rotate, the winder rollers (R4, R5) complete the formation of the log (RO) with the passage of the glued region (q') of the log's last sheet under the roller (R4). This causes the corresponding glueing of the last sheet of log (RO) upon that immediately below of the same log (FIG. 10). At this point, the speed of roller (R4) is increased and, by virtue of the speed difference thus created between the winder rollers (R4, R5), the log (RO) under formation is released and made to slide along a discharge guide (9) downstream of the winder rollers (R4, R5). Following this step, the rollers (R4, R5) reach again the running speed, and the place of (RO) is taken by the core (1) advancing towards the end part (30) of the guide (3) to allow the formation of a new log.

It will be appreciated that the interventions of said first and second glue-delivering means are suitably synchronized to each other to obtaining what has been previously described, and that the paper (2) is supplied with continuity onto the surface of the roller (RA) also during the advancement of the core (1) along the channel (C).

The winder roller (R4) is mounted on a corresponding support arm (400) which is hinged to a stationary part of the machine and is associated with an actuator (410) which allows it to be moved close to, and away from the lower winder roller (R5) in a manner known to those skilled in the art.

The above described operations can be performed automatically through programmable electronic means known to those skilled in the art and, therefore, will not be described in greater details.

From the above description of the machine and operating procedure it can be seen that it is possible to avoid using any gluing device downstream of the winder rollers, with evident economical advantages derived both from direct savings and the smaller space required for the plant. Also evident are the advantages derived from the novel system of transferring the glue onto the core: the glueing carried out within the winding region overcomes the problems due to the drying of the glue (which glue, by fulfilling immediately its function, is not subject to dry), and the application of a dual longitudinal line reduces the "unbalance" problems, as the regions of glue application form substantially two lines diametrically opposite with respect to the surface of the core (1).

Figure 12:
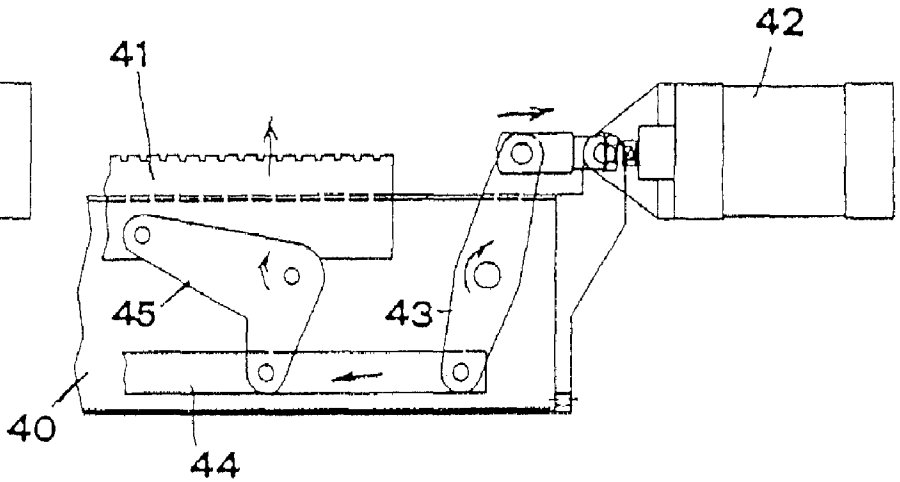
FIG. 12 shows the means of FIG. 11 in operative condition.
Figure 11:
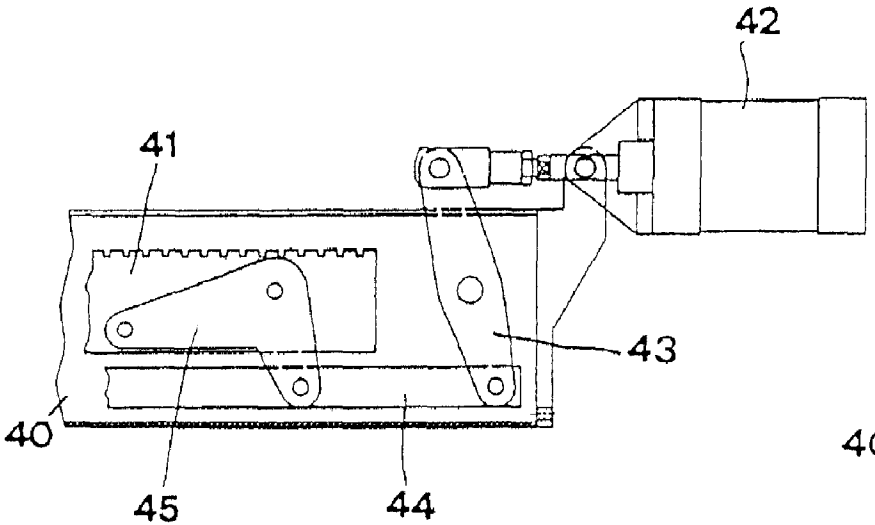
FIG. 11 is a schematic view in longitudinal section of the first means for the application of glue in inoperative or stand-by condition.
Figure 13:
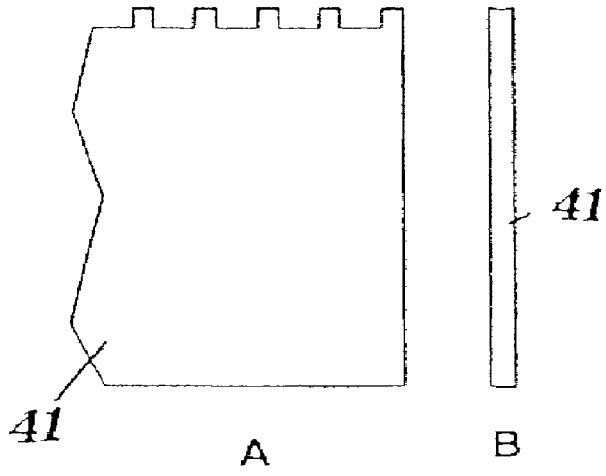
FIG. 13A is a partial side view of a possible embodiment of the blade for the means of FIGS. 11 and 12, in which the blade has thin and spaced apart teeth.
FIG. 13B is a front view of the blade of 13A.
Figure 14:
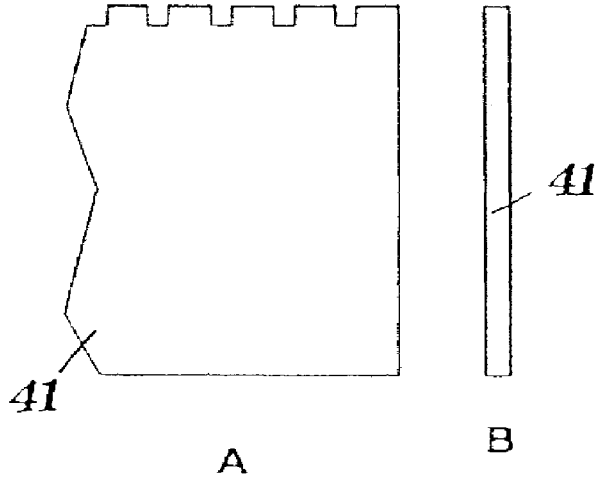
FIG. 14 is a partial side view of a possible embodiment of the blade for the means of FIGS. 11 and 12, in which the blade has large teeth.
Figure 15:
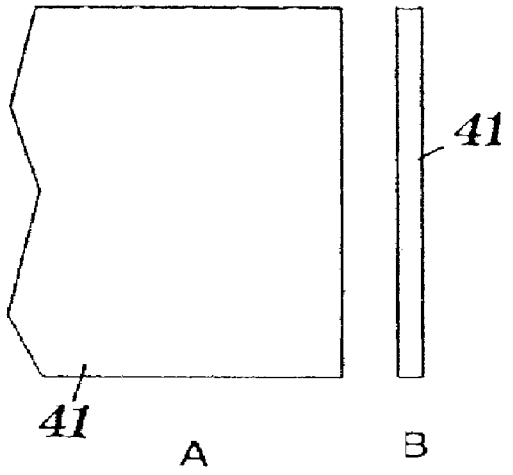
FIG. 15A is a partial side view of a possible embodiment of the blade for the means of FIGS. 11 and 12, in which the blade has a continuous, non-toothed profile.
FIG. 15B is a front view of the blade of FIG. 15A.

The first glue-application means (4) may comprise, with reference to the examples of FIGS. 11 and 12, a liquid-glue-holding reservoir (40) located below the guide (3), and a blade (41) provided inside said reservoir and movable from and to the channel (C) under control of a corresponding actuator (42) connected thereto via a chain of rigid transmissions (43, 44, 45). In the condition shown in FIG. 11, the blade (41) is fully held within the reservoir (40). In the condition shown in FIG. 12, the blade (41) is lifted by the withdrawal of the rod of actuator (42) and by the corresponding movements (as shown by the arrows) of members (43, 44, 45) of the transmission system. The lifting of blade (41) causes the application of the glue upon the surface of core (1) which, on that moment, is transiting along the channel (C). It will be appreciated that the guide (3) is suitably slotted to allow the lifting of the blade (41) and the contact thereof with the surface of blade (1). As illustrated in FIGS. 13A, 14A and 15A, the upper edge of the blade (41) may be either discontinuous, that is, provided with a toothing (FIGS. 13A and 14A), or continuous (FIG. 15A). Besides, as shown in FIGS. 13B, 14B and 15B, the upper edge of the blade (41) may be concave, with concavity turning upwards.

The second glue-application means (5) can be made like the first ones (4) and their description, therefore, will not be repeated.

Obviously, the number of sheets of each log (RO) and the length thereof may be as desired.

Figure 16:
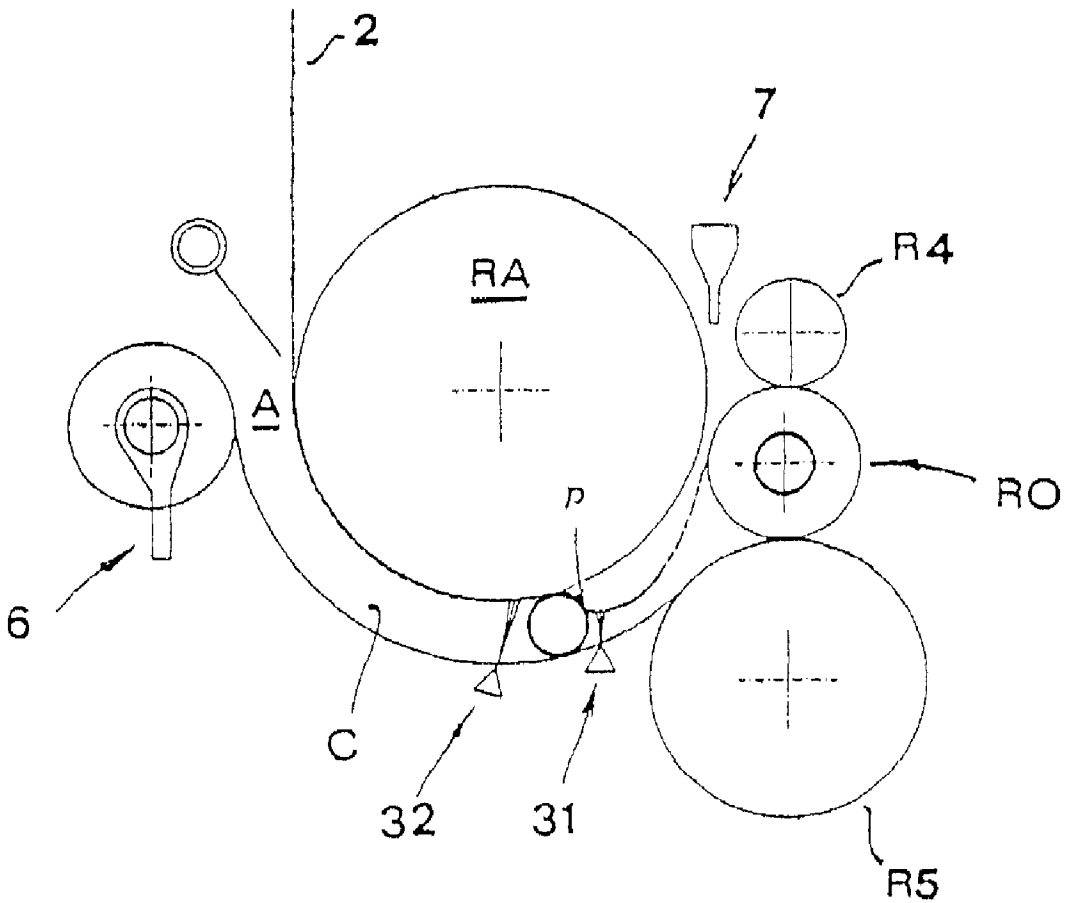
FIG. 16 is a schematic illustration of a further embodiment of a machine which makes it possible to actuate a method according to the invention.
Figure 17:
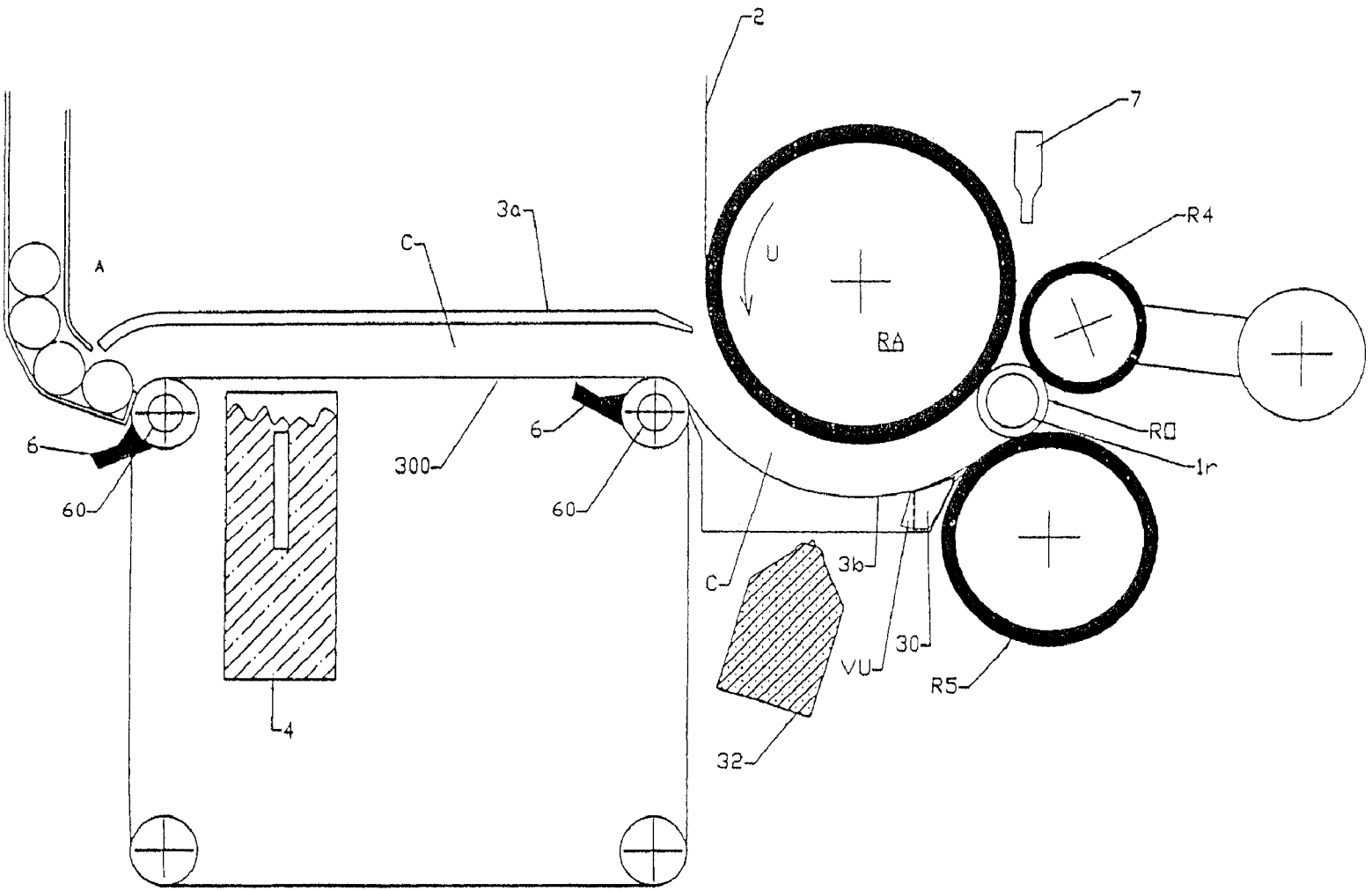
FIGS. 17-28 schematically show a machine which makes it possible to actuate a method according to the invention, in different sequential operating steps, with a further exemplary embodiment of the guide channel for the cores.
Figure 18:
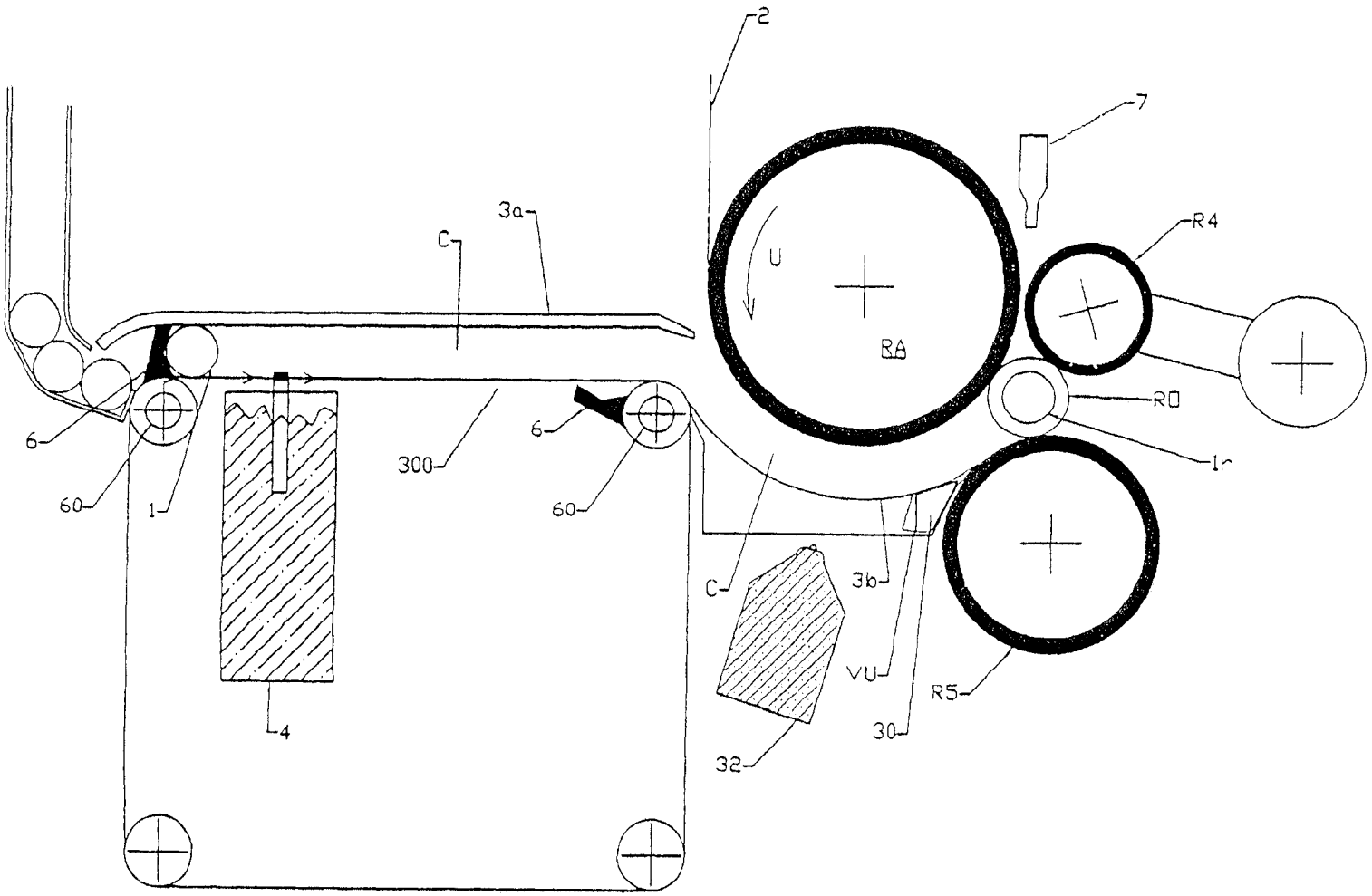
Figure 19:
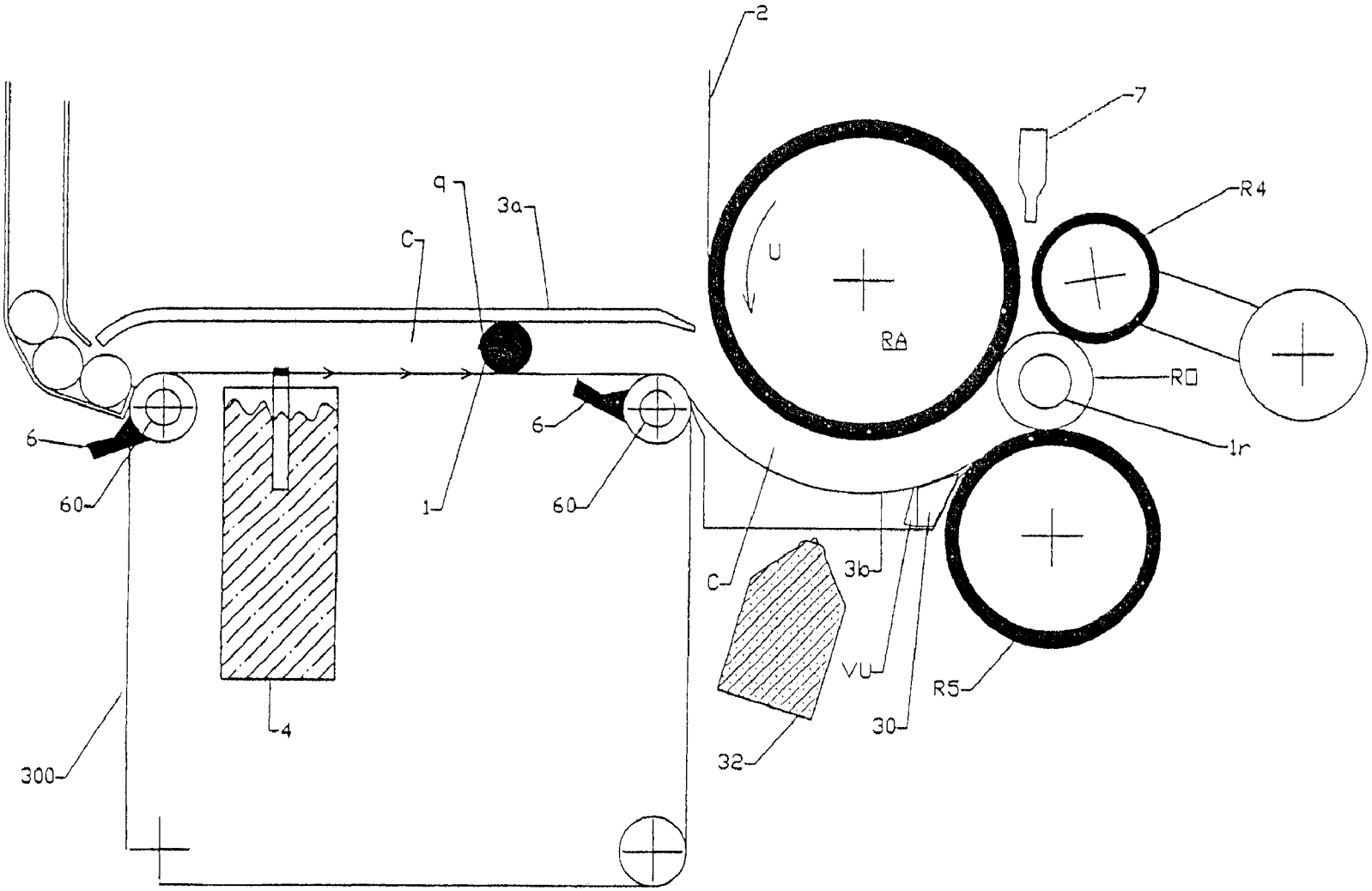
Figure 20:
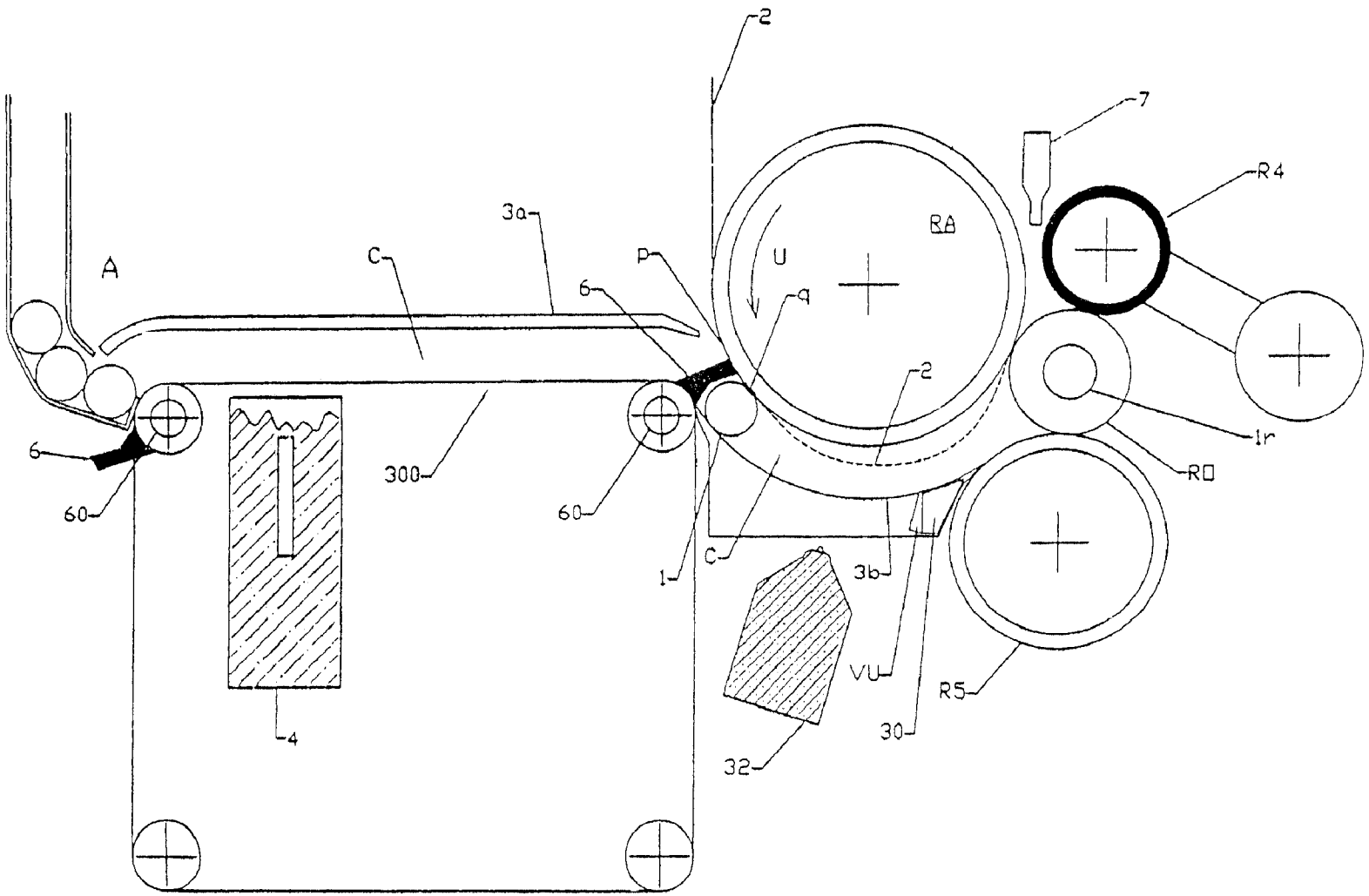
Figure 21:
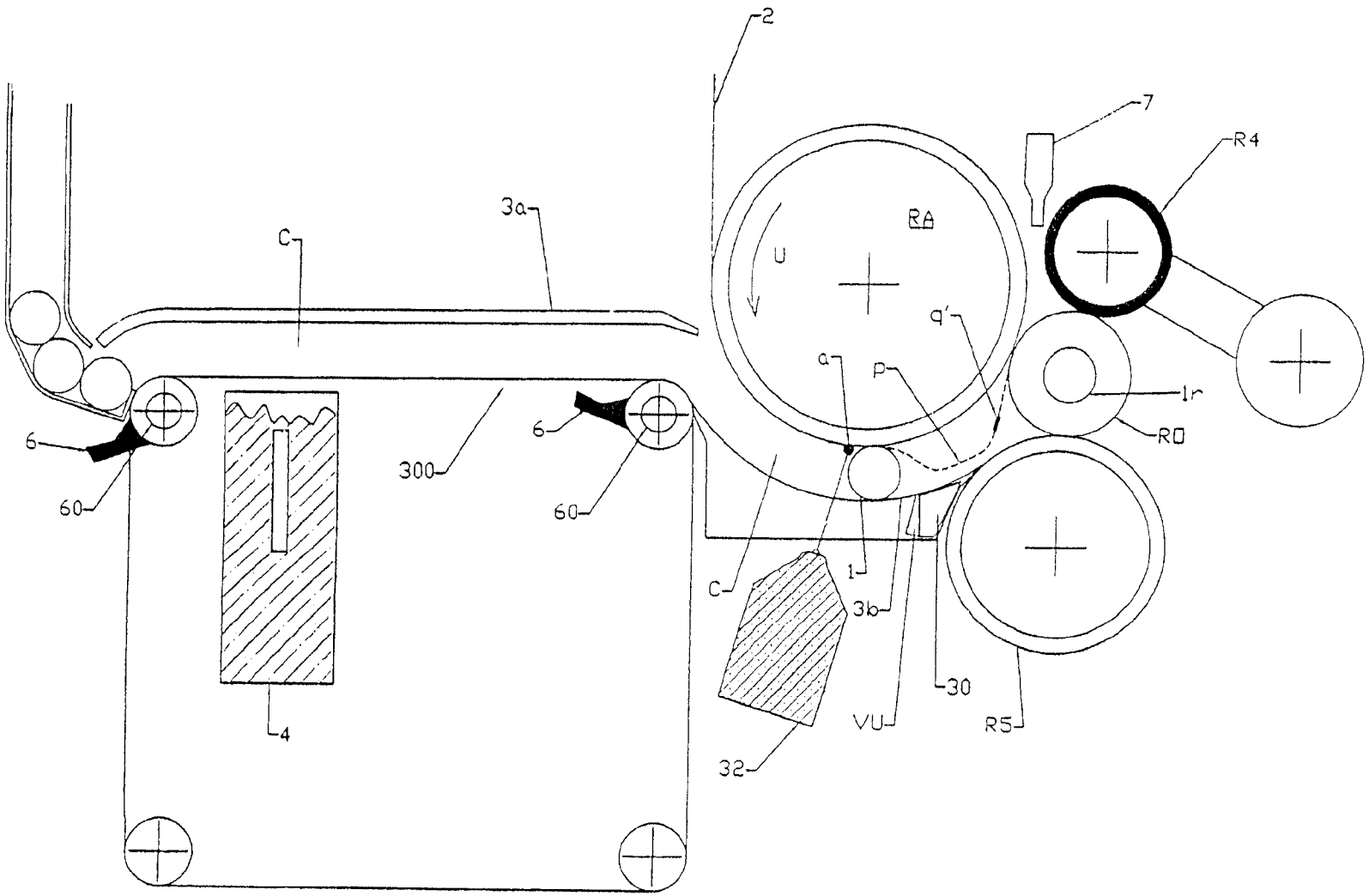
Figure 22:
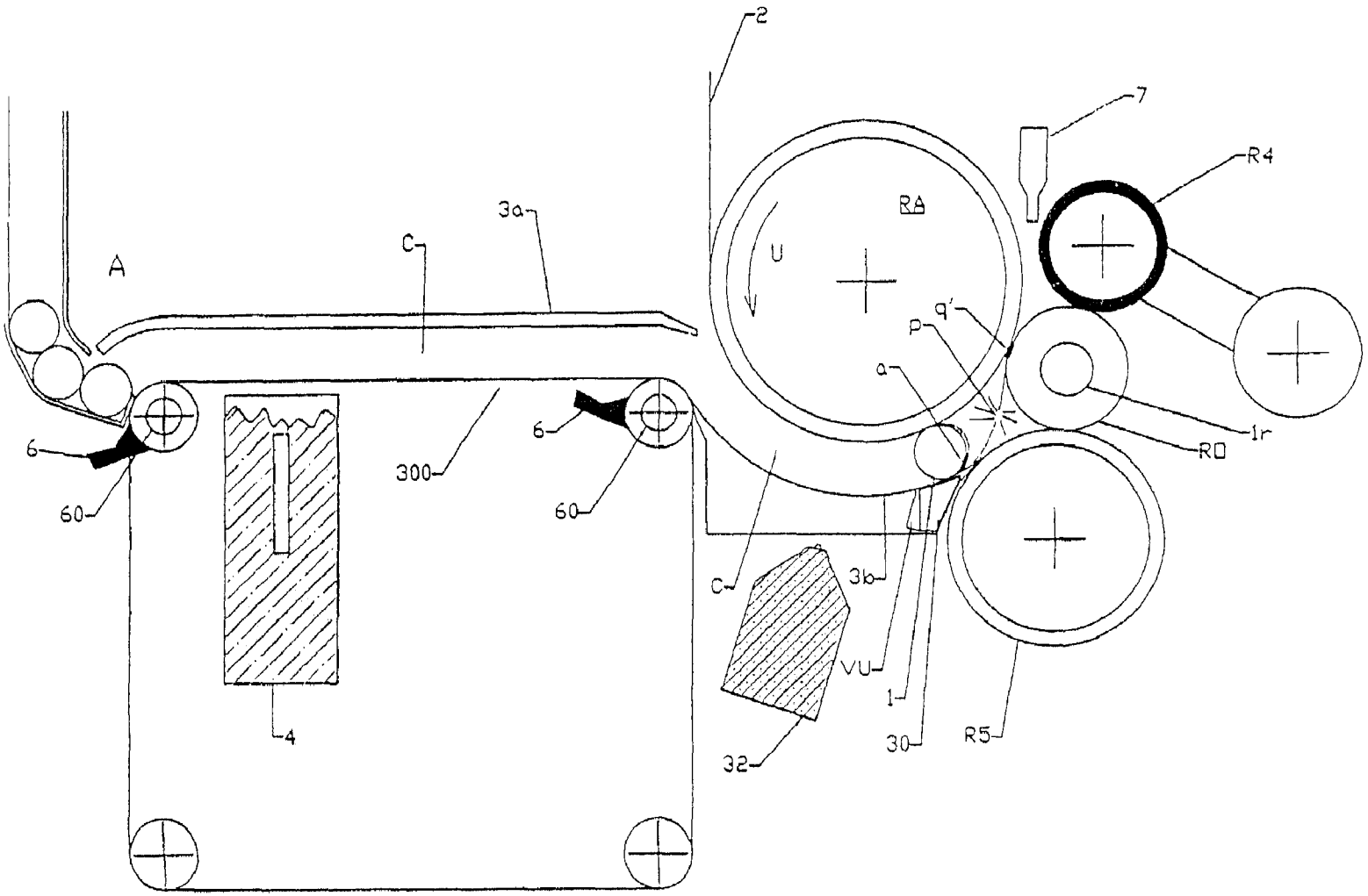
Figure 23:
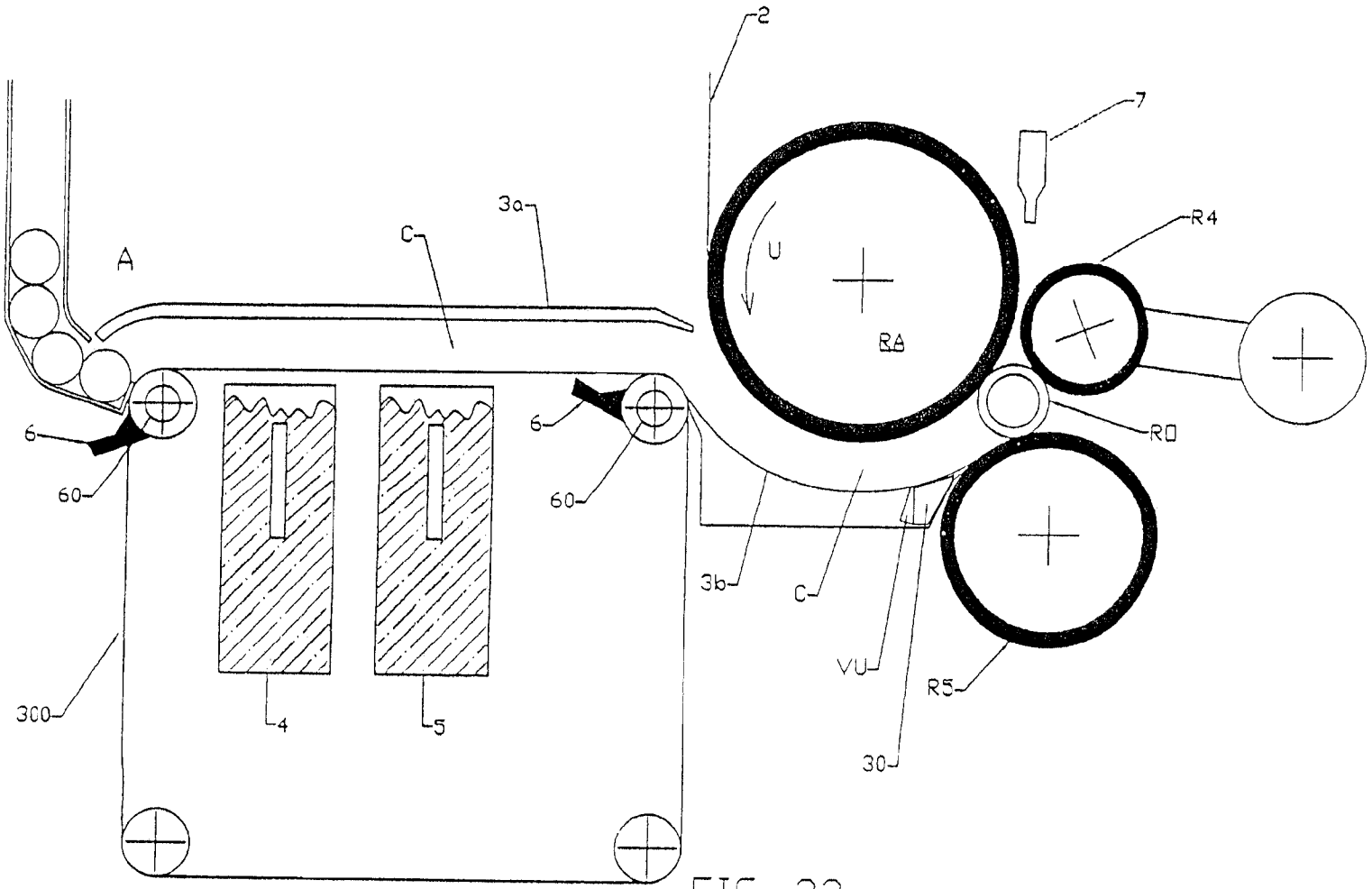
Figure 24:
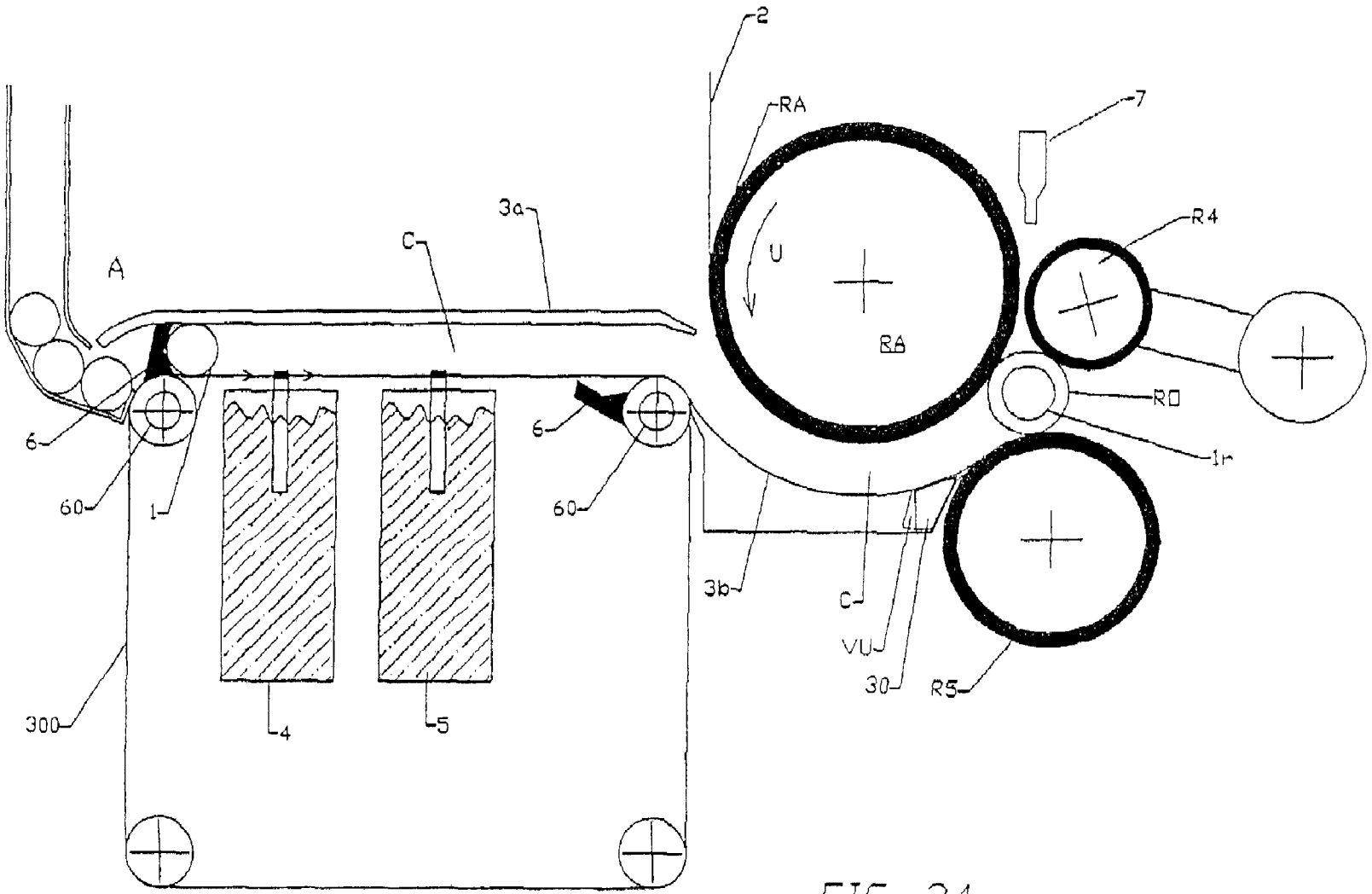
Figure 25:
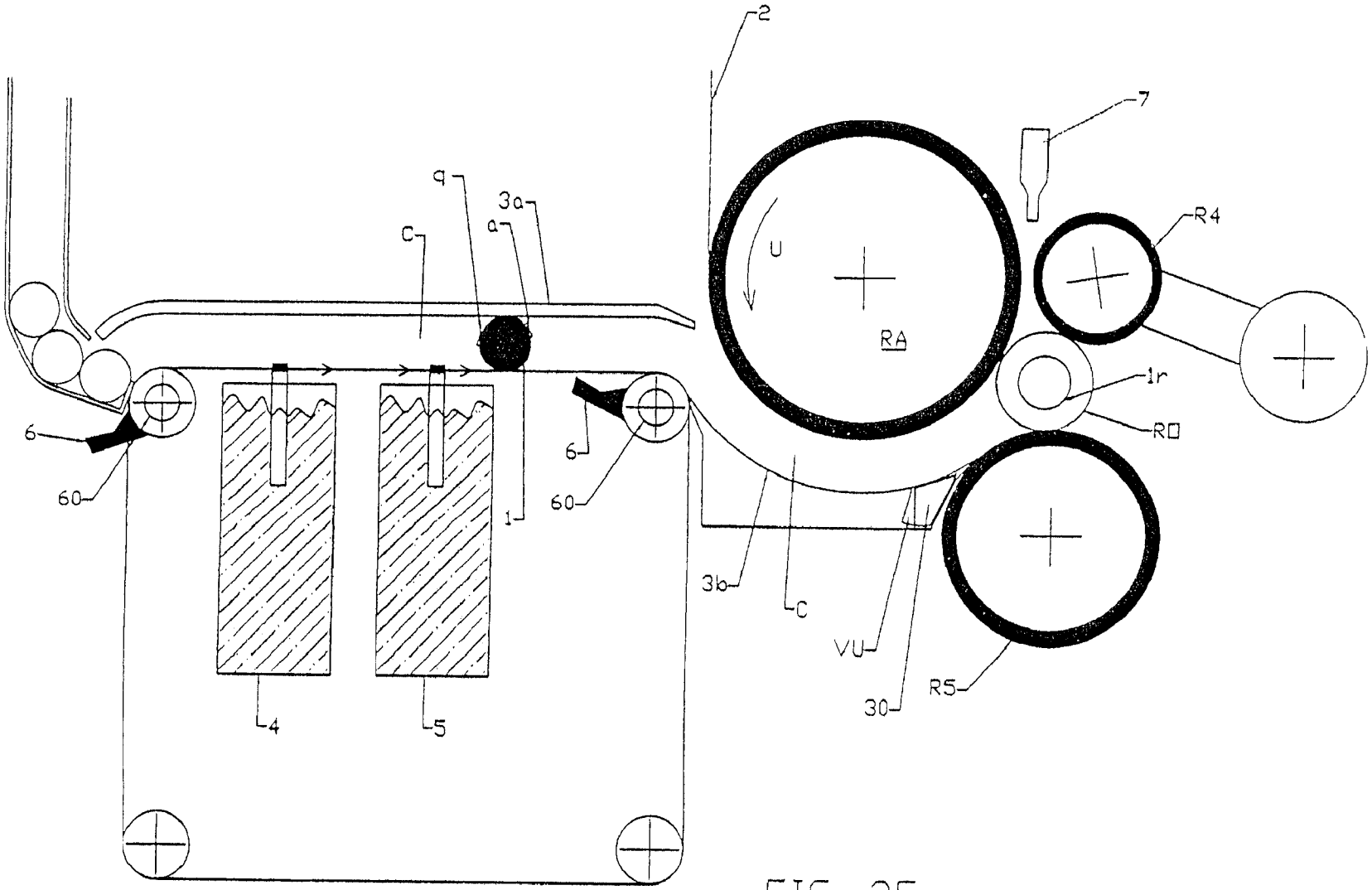
Figure 26:
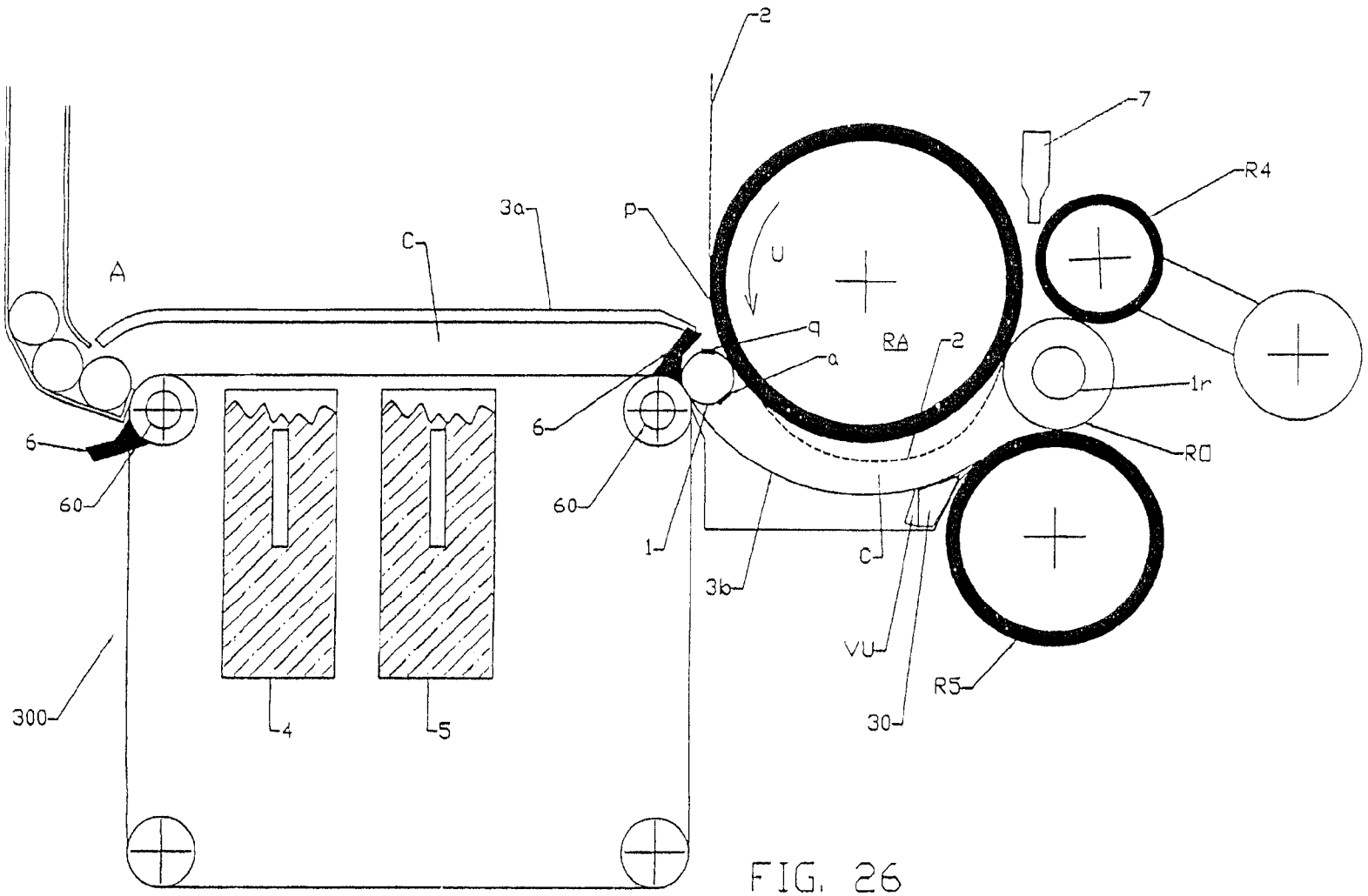
Figure 27:
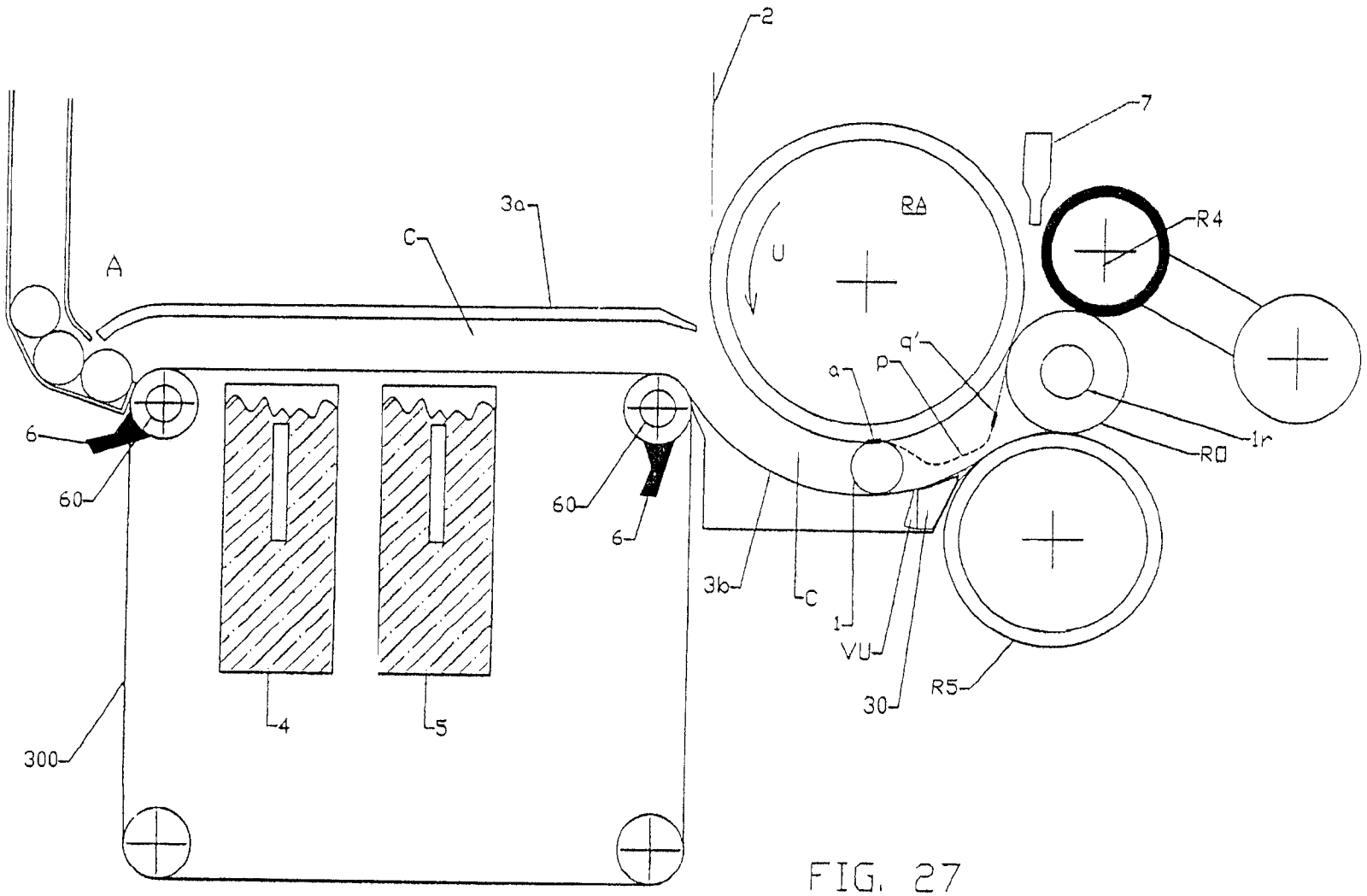
Figure 28:
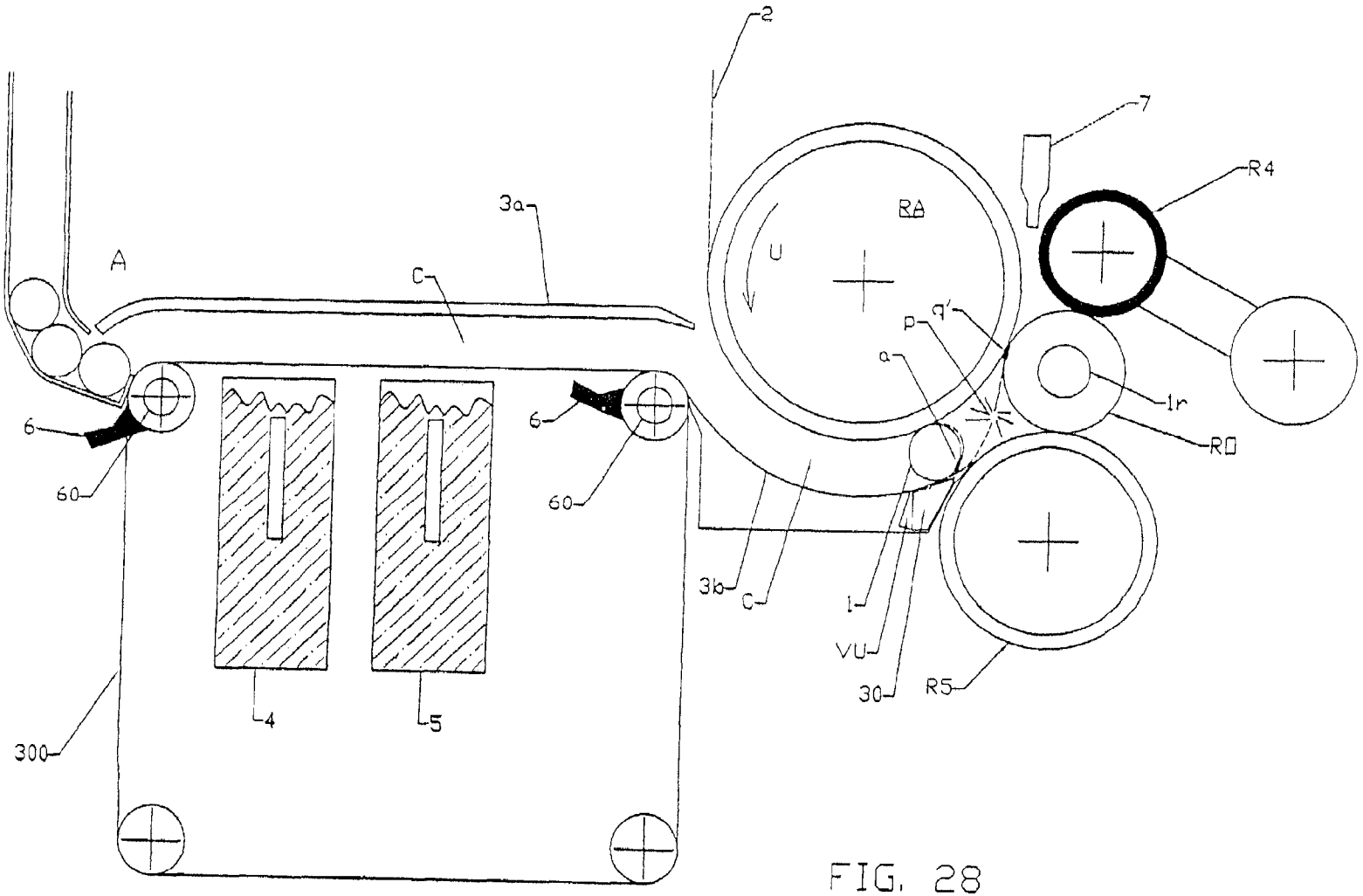

According to a further embodiment of the present invention, and with reference to FIG. 16, the glue can be delivered through two injectors (32, 31) intended for delivering the glue direct onto the paper (2) upstream and respectively downstream of a perforation line (p) which separates the last sheet of log (RO) under formation from the first sheet of the next log to be formed. The activation of said injectors (32, 31) can be concurrent, as schematically illustrated in FIG. 16.

As in the case previously described, the injectors (32, 31) are positioned within said channel (C) at a preset distance one from the other.

With reference to the examples of FIGS. 17-28, the stationary guide of said channel (C) is into two elements:

- a first element (3*a*) is opposite to an underlying conveyor belt (300) ring-like closed and located immediately downstream of the section (A) which feeds the tubular cores (1);
- a second element (3*b*) is located downstream of the first element (3*a*) and of said belt (300), opposite to roller (RA). The schematic representations of FIGS. 17-22 and respectively of FIGS. 23-28 differ from each other only for the different positioning of the glue-delivering means which, in any case, act within the said channel (C) and are positioned at a preset distance from each other.

The glue-delivering procedures can be combined as in FIGS. 17-22 where the first glue-delivering means are of blade type, and the second delivering means are of injection type.

While specific embodiments of the invention have been shown and described in detail to illustrate the application of the principles of the invention, it will be understood that the invention may be embodied otherwise without departing from such principles.

What is claimed is:

1. A method for producing logs of paper, the method comprising:

feeding a continuous paper web along a fixed path;

transversely perforating the paper web such that the paper is subdivided into various lengths and detached by tearing;

feeding tubes such that a preset number of sheets are wound onto said tube to form a log, said tubes being guided in a tube-guiding channel extending between a tube-feeding station and a log-forming station, said channel being delimited in part by a fixed guide and in part by a roller for feeding the paper; and applying glue within said channel such that the last sheet is glued to the log being formed and the paper web is glued to the next tube, said glue being applied upon two distinct regions of each tube such that a paper cutting line separates a last sheet of the log under formation from the first sheet of a subsequent log to be formed.

2. A method according to claim 1, tearing said last sheet under formation from the first sheet of a subsequent log to be formed due to fitting said first sheet between the surface of the corresponding spool and a fixed surface of said guide to form a tensioning of the paper.

3. A method according to claim 1, applying said glue in correspondence of the transit of each tube through a point within said channel, said point being intermediate between the tube-feeding station and the log-forming station.

4. A method according to claim 1, applying said glue in correspondence of the transit of each tube through two distinct points of said tube-guiding channel.

5. A method according to claim 1, wherein applying said regions are located at two diametrically opposite ends of each tube.

6. A method according to claim 5, applying said glue upon said regions of each tube such that a paper-cutting line separates the last sheet of the log under formation from the first sheet of a subsequent log to be formed.

7. A method according to claim 1, applying said glue such that along said tube-guiding channel each tube applies the glue, by contact, upon an edge of the last sheet of the log in the course of formation.

8. A method according to claim 1, applying said glue directly to the paper web, upstream and respectively downstream of a perforation line, said perforation line separating the last sheet of log under formation from the first sheet of the next log to be formed.

* * * * *